US006058620A

United States Patent [19]

Rolfi

[11] Patent Number: 6,058,620

[45] Date of Patent: May 9, 2000

[54] MACHINE FOR THE RAPID DRYING OF CROCKERY, CUTLERY, GLASSES AND SIMILAR OBJECTS

[75] Inventor: Emilio Rolfi, Torbole Casaglia, Italy

[73] Assignee: Hyppocampus S.r.l., Italy

[21] Appl. No.: 09/087,827

[22] Filed: May 29, 1998

[30] Foreign Application Priority Data

May 30, 1997 [IT] Italy ..... BS97A000047

[51] Int. Cl.[7] ..... F26B 25/00

[52] U.S. Cl. ..... 34/105; 34/106; 34/217

[58] Field of Search ..... 34/59, 60, 72, 34/80, 83, 89, 103, 104, 105, 106, 107, 108, 201, 202, 217, 237; 118/64, 641, 642, 308; 427/542, 372.2

[56] References Cited

U.S. PATENT DOCUMENTS

| | | | |
|---|---|---|---|
| 3,574,951 | 4/1971 | Oetjen | 34/217 X |
| 3,729,835 | 5/1973 | Massett | 34/225 X |
| 4,188,732 | 2/1980 | Quayle | 34/78 X |
| 4,663,860 | 5/1987 | Beall | 34/217 X |
| 5,337,498 | 8/1994 | Smith | 34/225 X |
| 5,385,611 | 1/1995 | Matsumoto et al. | 34/105 X |
| 5,813,138 | 9/1998 | Barabe et al. | 34/217 X |

*Primary Examiner*—Stephen Gravini

*Attorney, Agent, or Firm*—McGlew and Tuttle, P.C.

[57] ABSTRACT

The present invention concerns a machine for the rapid drying of crockery, cutlery, glasses, and similar objects using the passage of a drying material. Inside of a body or housing there is included a loading plate (11) for the objects to be dried; a tank (13) of drying material; and some ducting (14) for the conveying and blowing of the drying material from the tank to the objects on the said loading plate from different directions.

20 Claims, 1 Drawing Sheet

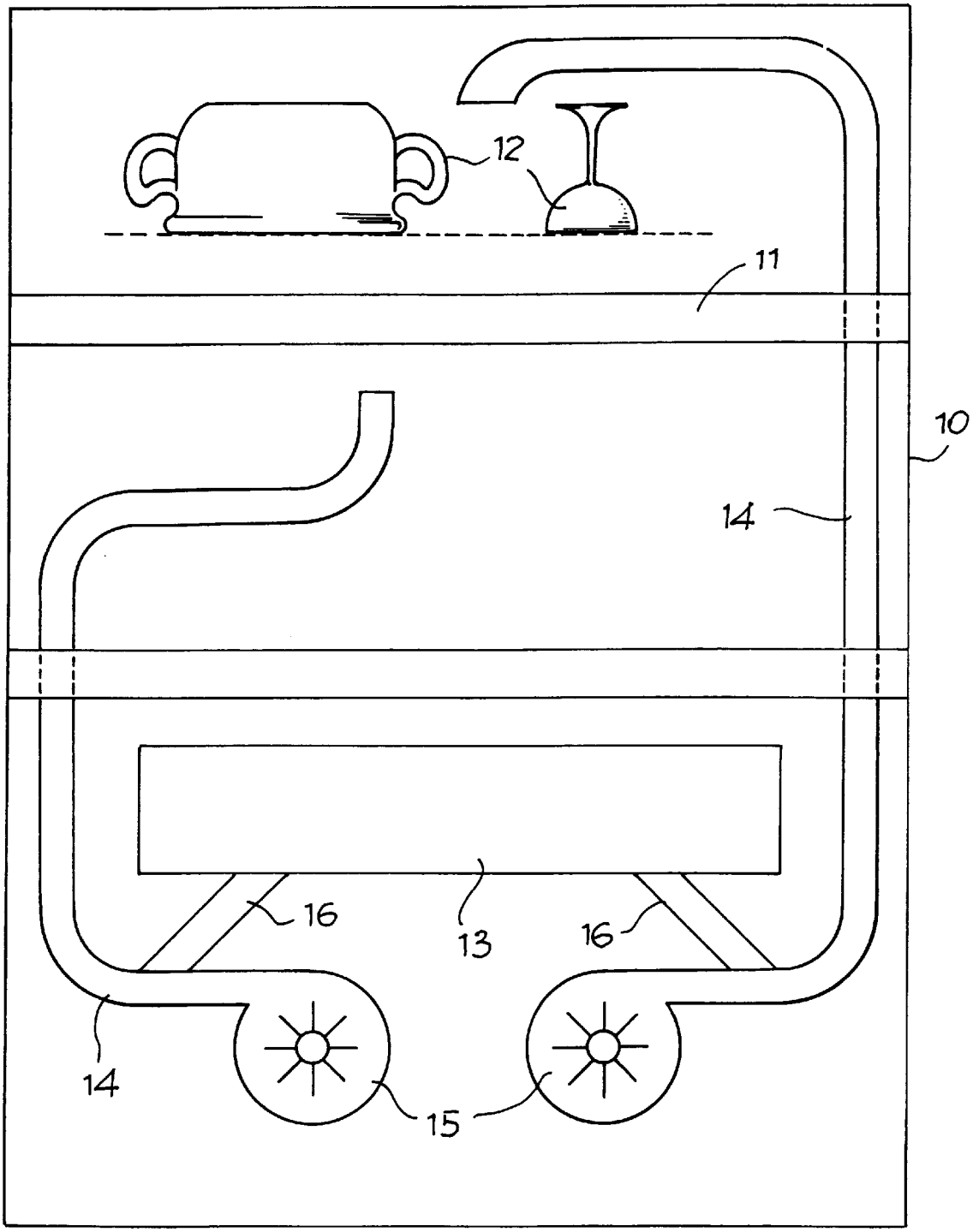
12
11
10
14
16
13
16
14
15

MACHINE FOR THE RAPID DRYING OF CROCKERY, CUTLERY, GLASSES AND SIMILAR OBJECTS

FIELD OF THE INVENTION

The present invention concerns a machine for the drying of crockery, cutlery, glasses and similar objects after they have been washed in a washing machine.

BACKGROUND OF THE INVENTION

A machine has already been proposed for the drying and polishing of cutlery employing the use of a sterilised drying material, such as fragments of corncobs or similar. In one of those machines, the cutlery is sent to or placed directly in a quantity of drying material and moved mechanically with respect to the material itself for a sufficient process time. The drying material then remains in contact with the cutlery until the end of the drying process and their removal, and are removed and substituted when exhausted.

SUMMARY AND OBJECTS OF THE INVENTION

The primary object of the invention is to provide a machine for the drying of objects with a granular drying material, in which the drying material is made to circulate pneumatically and is blown onto the objects for a more efficient and rapid drying even in the presence of elements of differing material, dimensions and shapes.

According to the invention, a machine for the rapid drying of objects is provided. The machine includes a housing and a loading plate for the objects to be dried. The loading plate is disposed in the housing. Granular drying material is provided. A granular material holding tank is associated with the housing or connected with the housing. The tank holds an amount of drying material. The machine also includes a fan and a duct with a duct portion in the housing. The duct is connected to the tank and the fan is connected to the duct for cooperating with the tank and cooperating with the duct for conveying the drying material from the tank on to the objects on the loading plate.

The blowing can be regulated in such a way that the impact of the drying material on the objects is both light and has no adverse effects on more delicate parts, while ensuring the efficiency of the drying treatment without leaving undesirable marks.

BRIEF DESCRIPTION OF THE DRAWINGS

The only FIGURE is a schematic illustration of an example of a system utilizing the invention.

DESCRIPTION OF THE PREFERRED EMBODIMENT

In the said design, the body or housing of the machine is shown as (10), inside of which there is provided a loading plate (11) destined to receive the objects to be dried (12), and a tank (13) destined to contain a granular drying material of the above mentioned type, for example.

The loading plate (11) can be of a rotary type in order to receive the objects (12) from an entry aperture and for transferring them to an outlet aperture not —illustrated—.

The drying material tank (13) can be positioned at the bottom, under the loading plate (11). From the tank (13), there extends some ducting (14) to transport the drying material to the objects to be dried, directed onto them from above and below. The conveying of the drying material along the ducting is effected pneumatically, for example by means of fans (15) connected to this ducting. Between the tank (13) and the ducting (14) there can be inserted metering devices(16) to vary and regulate the flow of drying material onto the objects.

In practice, the objects, the crockery, cutlery, glasses, etc., which are located on, or move with, the loading plate, are impacted by the blown drying material, so being dried, while the material falls back to be reused continuously until it is exhausted.

I claim:

1. A machine for the rapid drying of objects, the machine comprising:

a housing;

a loading plate for the objects to be dried, said loading plate being disposed in said housing;

granular drying material;

a granular drying material holding tank associated with said housing, said tank for holding an amount of said granular drying material;

a fan;

a duct with a duct portion in said housing, said duct being connected to said tank, said fan being connected to said duct for cooperating with said tank and said duct for pneumatically conveying the drying material from said tank to the objects on said loading plate.

2. The machine according to claim 1, wherein said loading plate is stationary.

3. The machine according to claim 1, wherein said loading plate is mounted for rotary movement to carry the objects from an entry aperture to an outlet aperture of said housing.

4. The machine according to claim 1, further comprising a metering device between said tank and said duct for the regulation of the delivery flow of the drying material.

5. The machine according to claim 2, further comprising a metering device between said tank and said duct for the regulation of the delivery flow of the drying material.

6. The machine according to claim 3, further comprising a metering device between said tank and said duct for the regulation of the delivery flow of the drying material.

7. A machine for the rapid drying of objects, the machine comprising:

a housing;

a loading plate for the objects to be dried, said loading plate being disposed in said housing;

non-combusted granular drying material;

a granular drying material holding tank associated with said housing, said tank for holding an amount of said granular drying material;

a fan;

a duct with a duct portion in said housing, said duct being connected to said tank, said fan being connected to said duct for cooperating with said tank and said duct for pneumatically conveying the drying material from said tank onto the objects on said loading plate.

8. The machine according to claim 7, wherein said loading plate is stationary.

9. The machine according to claim 7, wherein said loading plate is mounted for rotary movement to carry the objects from an entry aperture to an outlet aperture of said housing.

10. The machine according to claim 7, further comprising a metering device between said tank and said duct for the regulation of the delivery flow of the drying material.

11. The machine according to claim 8, further comprising a metering device between said tank and said duct for the regulation of the delivery flow of the drying material.

12. The machine according to claim 9, further comprising a metering device between said tank and said duct for the regulation of the delivery flow of the drying material.

13. A machine for the rapid drying of objects, the machine comprising:

a housing;

a loading plate for the objects to be dried, said loading plate being disposed in said housing;

granular drying material including fragments of corncobs;

a granular drying material holding tank associated with said housing, said tank holding an amount of said granular drying material;

a fan;

a duct with a duct portion in said housing, said duct being connected to said tank, said fan being connected to said duct for cooperating with said tank and said duct for conveying the drying material from said tank onto the objects on said loading plate.

14. The machine according to claim 13, wherein said loading plate is stationary.

15. The machine according to claim 13, wherein said loading plate is mounted for rotary movement to carry the objects from an entry aperture to an outlet aperture of said housing.

16. The machine according to claim 13, further comprising a metering device between said tank and said duct for the regulation of the delivery flow of the drying material.

17. The machine according to claim 14, further comprising a metering device between said tank and said duct for the regulation of the delivery flow of the drying material.

18. The machine according to claim 15, further comprising a metering device between said tank and said duct for the regulation of the delivery flow of the drying material.

19. The machine according to claim 1, wherein said fan and duct cooperate such that the drying material impacts on the objects.

20. The machine according to claim 7, wherein said fan and duct cooperate such that the drying material impacts on the objects.

* * * * *